US005537763A

United States Patent [19]

Donnadieu et al.

[11] Patent Number: 5,537,763

[45] Date of Patent: Jul. 23, 1996

[54] BOOT WITH TIGHTENING SYSTEM WITH MEMORIZATION OF TENSION

[75] Inventors: Thierry Donnadieu, Poisy; Patrick Leick, Villaz, both of France

[73] Assignee: Salomon S.A., Metz-Tessy, France

[21] Appl. No.: 395,534

[22] Filed: Feb. 28, 1995

Related U.S. Application Data

[63] Continuation of Ser. No. 52,700, Apr. 27, 1993, abandoned.

[30] Foreign Application Priority Data

Nov. 6, 1992 [FR] France ..... 92 13567

[51] Int. Cl.[6] ..... A43C 11/14

[52] U.S. Cl. ..... 36/50.1; 36/50.5

[58] Field of Search ..... 36/50.5, 117, 50.1; 24/685 K, 695 K, 705 K, 715 K, 712.1, 712.2, 712.3, 712.4, 712.5, 712.6

[56] References Cited

U.S. PATENT DOCUMENTS

| | | | |
|---|---|---|---|
| 1,088,067 | 2/1914 | Forbes | 36/50.1 |
| 2,321,754 | 6/1943 | Koehler | 24/712.4 |
| 3,545,106 | 12/1970 | Martin | 36/50 |
| 3,975,838 | 8/1976 | Martin | 36/50 |
| 4,142,307 | 3/1979 | Martin | 36/50 |
| 4,408,403 | 10/1983 | Martin | 36/54 |
| 4,706,393 | 11/1987 | Marxer . | |
| 4,937,952 | 7/1990 | Oliveri | 36/50.5 |
| 4,999,889 | 3/1991 | LeCouturer | 24/713.2 |
| 5,062,225 | 11/1991 | Gorza | 36/50.5 |
| 5,129,130 | 7/1992 | Lecouturier | 24/712.6 |
| 5,187,884 | 2/1993 | Baggio et al. | 24/685 K |
| 5,237,759 | 8/1993 | Chaigne | 36/50.5 |
| 5,269,621 | 12/1993 | De Bortoli et al. | 36/50.5 |

FOREIGN PATENT DOCUMENTS

| | | | |
|---|---|---|---|
| 0230063 | 7/1987 | European Pat. Off. . | |
| 1115248 | 4/1956 | France | 36/50.5 |
| 2657508 | 8/1991 | France | 36/50.5 |
| 253984 | 5/1967 | Germany | 36/50.5 |
| 1273371 | 7/1968 | Germany . | |
| 2414439 | 10/1975 | Germany . | |
| 4024782 | 6/1991 | Germany | 24/712.4 |
| 9016325.7 | 8/1991 | Germany | A43C 11/20 |
| 596784 | 3/1978 | Switzerland | 36/50.5 |

*Primary Examiner*—Paul T. Sewell
*Assistant Examiner*—Ted Kavanaugh
*Attorney, Agent, or Firm*—Greenblum & Bernstein

[57] ABSTRACT

Flexible sports boot including a closing system, provided with a device for memorizing its tightening tension, including an opening and closing system by lacing comprising a link forming a closed circuit integrating tightening and latching device and connecting to each other, along a predetermined path, a series of return elements located in a fixed manner on either side of the quarters of upper, wherein the opening and closing system of the upper includes, in addition, a progressive adjustment device for relocating an optimum reference tightening tension of link, during its latching command, the adjustment device being independent of the tightening and latching device so as to enable the memorizing of the reference tightening tension, the tightening being undertaken only by the tightening and latching device, which can be rendered detachable from a fixed complementary gripping portions obtained on upper, so as to obtain a greater unlacing amplitude of link during opening, without affecting the adjustment of its memorized reference tension.

21 Claims, 8 Drawing Sheets

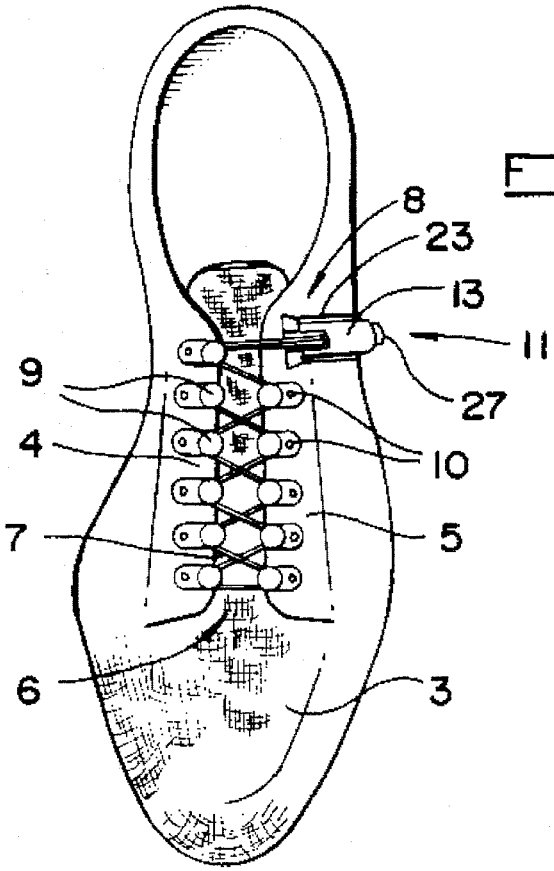
Fig- 2
Fig- 3
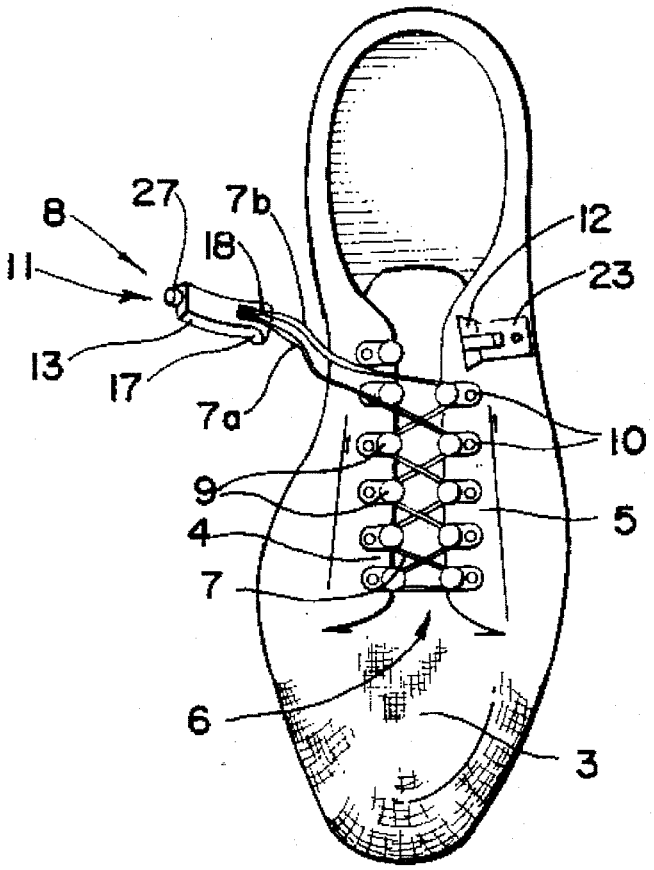
Fig- 4
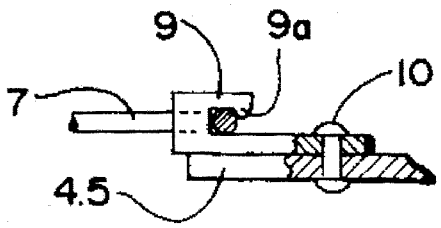

BOOT WITH TIGHTENING SYSTEM WITH MEMORIZATION OF TENSION

CROSS-REFERENCE TO RELATED APPLICATION

This application is a continuation of application No. 08/052,700 filed on Apr. 27, 1993, now abandoned.

BACKGROUND OF THE INVENTION

1. Field of the Invention

The present invention is related to a sports boot comprising an external sole overlaid by an upper obtained from a flexible material, open frontwardly, to enable passage of the foot and comprising, to this end, two quarters adapted to be connected to each other by an opening and closing system of the lacing type. This system includes a link forming a closed circuit integrating a tightening and latching mechanism and connecting to, along a predetermined path, a series of return elements located in a fixed manner on either side of the quarters so that when a traction force is exerted on the link, via the tightening and latching mechanism, the link exerts a closing action on said quarters to bring them closer to one another and consequently ensures retention of the foot.

2. Discussion of Background and Relevant Information

The German Utility Model G 90 16325.7 describes a boot of this type, whose opening and closing system of the upper is constituted by a flexible link in a closed circuit connected to a winder around which the link is wound when a rotational action is exerted on said winder, resulting in shortening the length of the circuit and consequently causing the quarters of the upper to come closer together for closure and tightening thereof. To undertake opening of the quarters, disengagement means of the winder enable the winder to release the tension on the link and obtain its unwinding which is caused by a frontward thrust of the foot in order to open the boot.

Not only does this require an additional effort from the user at the time of removal of the boot, the user being obliged to provide a force to overcome the inertia of the winder and unwind the link sufficiently in order to be able to remove the foot from the boot, which adds to the friction of the link in the return elements, but in addition, once the winder is disengaged, there is no memorization means enabling the tightening to be relocated, said tightening having been adjusted precisely by the user, and consequently, the user will have to undertake this action anew the next time the boot is put on.

Presumably, the lacing device described in U.S. Pat. No. 4,999,889 enables this disadvantage to be resolved because, as per the illustration of FIG. 11 of this document, the end of the closed circuit, formed by the link, is connected in a non-detachable manner to a tightening element which is itself journalled on the upper. Although such a device indeed appears to enable memorization of the tightening, the tightening tension being obtained by adjustment of the length of the link by a knot, the opening of the upper must necessarily be undertaken by detaching the link from the return elements, at least along a portion of the tightening length, so that it can take slack. Such an intervention on the boot can be difficult, or at least time-consuming for the user. In addition, the tightening tension of the link is invariable, except if one intervenes at the level of the knot.

The same document presents a variation, illustrated in FIG. 10, which could enable this disadvantage to be avoided because the tightening element, incidentally, a journalled notched lever, can be removed from the link. However, there would be no further possibility of memorizing the tightening tension which must be relocated each time the boot is put on.

SUMMARY OF THE INVENTION

It is an object of the present invention to overcome these various disadvantages and as such, it is related to an above-cited type of boot, wherein the opening and closing system of the upper comprises, in addition, progressive adjustment means for relocating an optimum reference tightening tension of the link during latching thereof, the adjustment means being independent of the tightening and latching means so as to enable a memorization of the reference tightening tension, so that it can be reproduced during each opening/closing operation of the upper undertaken only by the tightening and latching means, such means being capable of being detached from a fixed complementary gripping portion obtained on the upper, in order to obtain a greater unlacing amplitude of the link during opening, without affecting the adjustment of the memorized reference tension.

BRIEF DESCRIPTION OF THE DRAWINGS

The invention will be better understood and other characteristics thereof will be rendered clearer with the help of the description that follows, with reference to the schematic annexed drawings, illustrating, as a non-limiting example, how the invention can be obtained and wherein:

FIGS. 2 and 3 are top plan views of a boot as per FIG. 1, respectively closed and open;

FIG. 4 is a detailed view of a return element of the link;

DETAILED DESCRIPTION OF THE PREFERRED EMBODIMENTS

Figure 1:
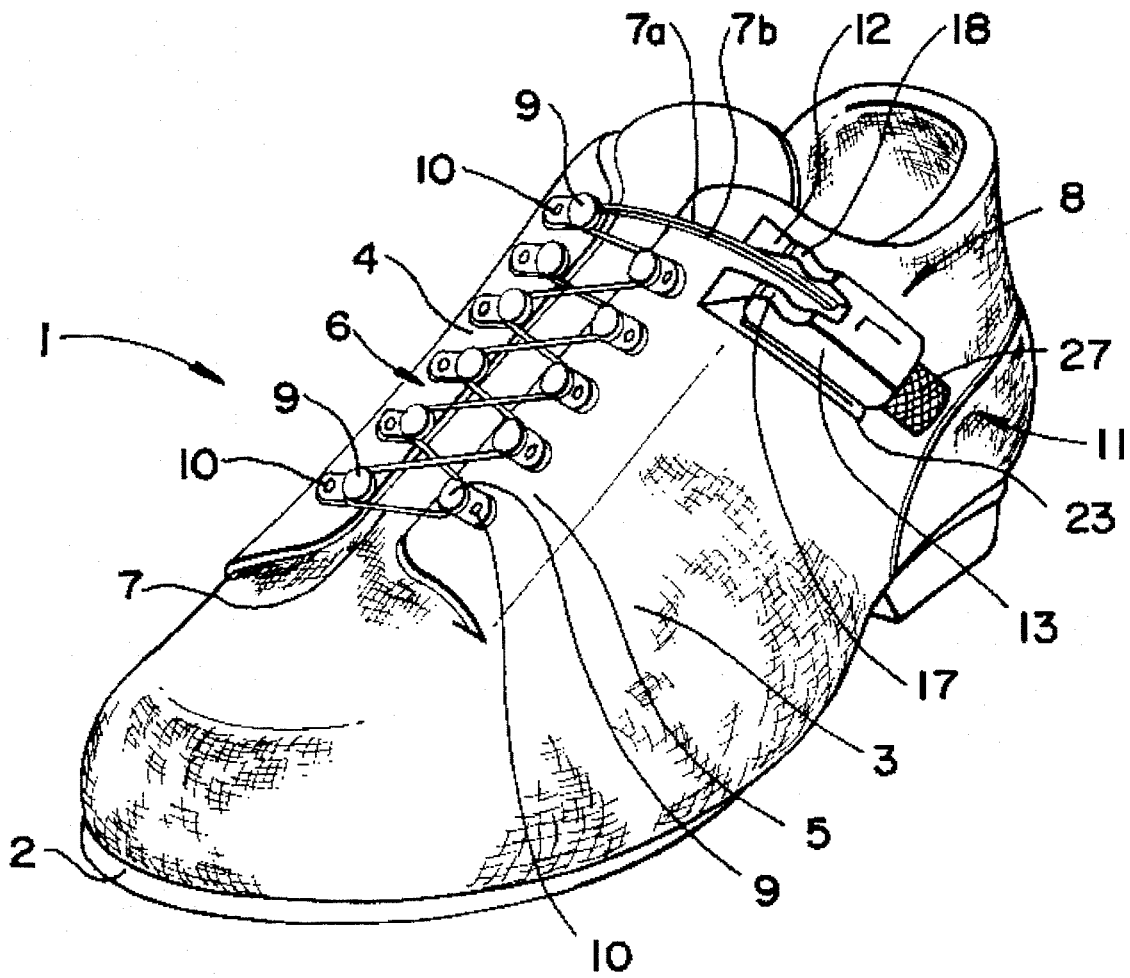
FIG. 1 is a perspective view of a flexible boot comprising a device for latching and adjusting the tightening tension of the closure link, as per the invention.

Boot 1, designated in its entirety in FIG. 1, is a sports boot comprising an external sole 2 overlaid by an upper 3 made of a flexible or supple material and open frontwardly to enable passage of the foot. To this end, it comprises two quarters 4, 5 adapted to be connected to each other by an opening and closing system of the lacing type 6. This system comprises a link 7 forming a closed circuit integrating tightening and latching means 8, and connecting to each other, along a predetermined crossed path, a series of return elements 9.

As can been seen in FIG. 4, each of such elements 9 comprises a passage in the shape of a hook behind which is engaged a link buckle 7. These passages 9 are arranged in a fixed manner on either side of the quarters 4, 5, such that when a traction is exerted on link 7 via the tightening and latching means 8, such link 7 exerts a closing action on the quarters 4, 5 to bring them closer to one another and consequently to ensure an internal retention of the foot. Further, each passage 9 has, on the side of the opening of the hook, a projection 9*a* adapted to retain link 7 in position in the passage, when the boot is not closed (link without tension).

According to the invention and generally speaking, the opening and closing system of upper 3 comprises in addition progressive adjustment means or mechanism 11 for relocating an optimum reference tightening tension of link 7, during latching, the adjustment means 11 being independent of the tightening and latching means 8 so as to enable memorization of the reference tightening tension, so that it can be reproduced during each opening/closing operation of upper 3, such operation being undertaken only by the tightening and latching means 8 which can be rendered detachable from a fixed complementary gripping portion 12 obtained on upper 3, in order to obtain a greater unlacing amplitude of link 7 during opening, without affecting the adjustment of the memorized reference tension. It should be noted that the progressive tightening can be obtained in a continuous manner (a system with screws for example) or in a discontinuous manner (system with notches or teeth).

The tightening and latching means 8 comprise a tensioning lever 13 located on a portion of the closed circuit, formed by link 7.

The tensioning lever 13 comprises a means for connecting the free ends of the two slack ends 7*a*, 7*b* forming link 7 so as to close it on itself.

The tensioning lever 13 comprises removable connection means 14 located at one of its ends, and which are capable of cooperating with the complementary means of the fixed gripping portion 12 of upper 3.

Figure 6:
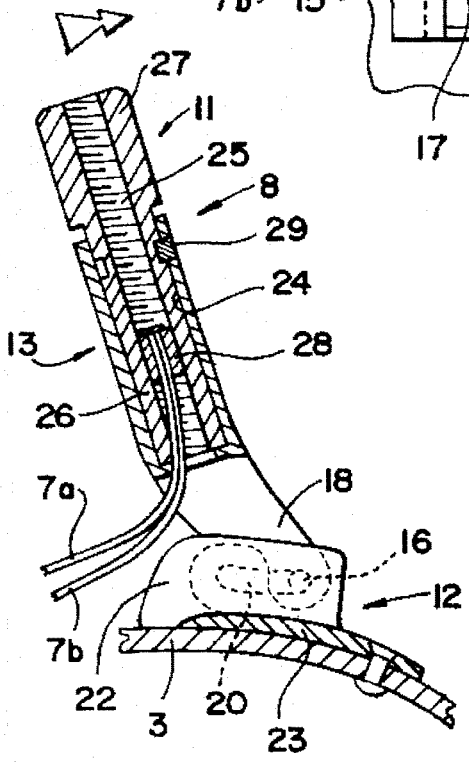
Figure 7:
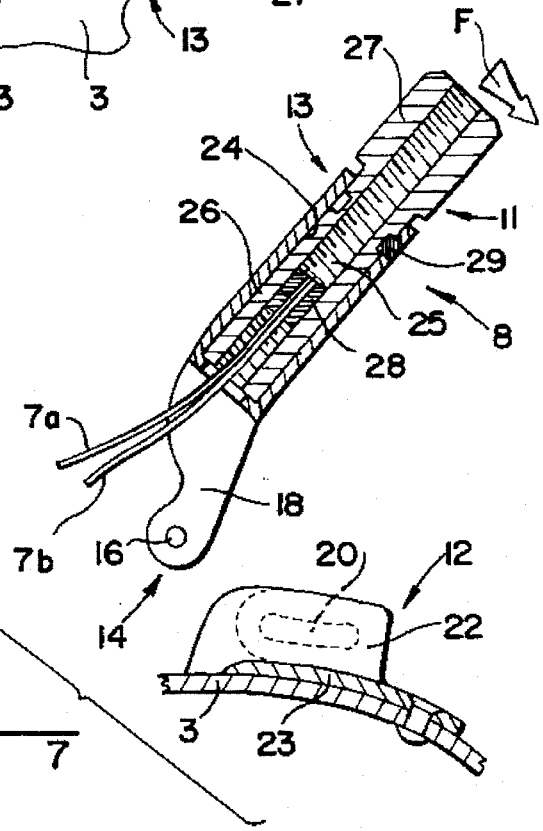
Figure 8:
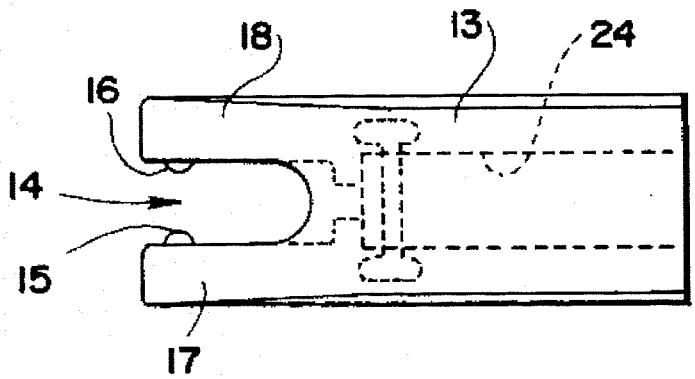
FIGS. 8 and 9 represent a tensioning lever of the device as per the preceding figures, respectively seen in a plan view and a side view.
Figure 9:
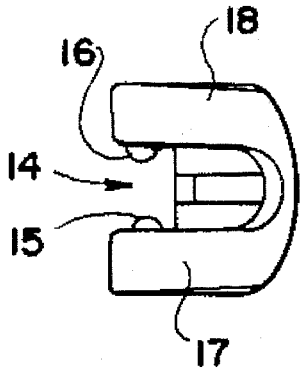
Figure 11:
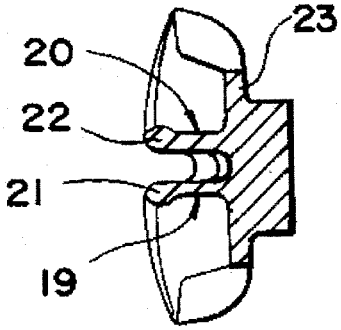
FIG. 11 is a sectional view along line XI–XI of FIG. 10.
Figure 10:
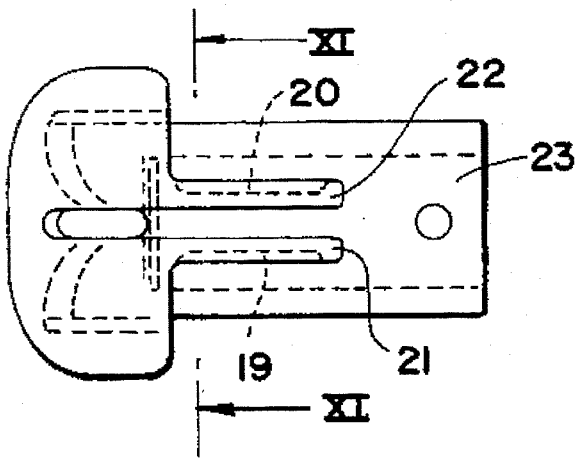
FIG. 10 represents a base of the device according to FIGS. 1–7, seen in a plan view.
Figure 12:
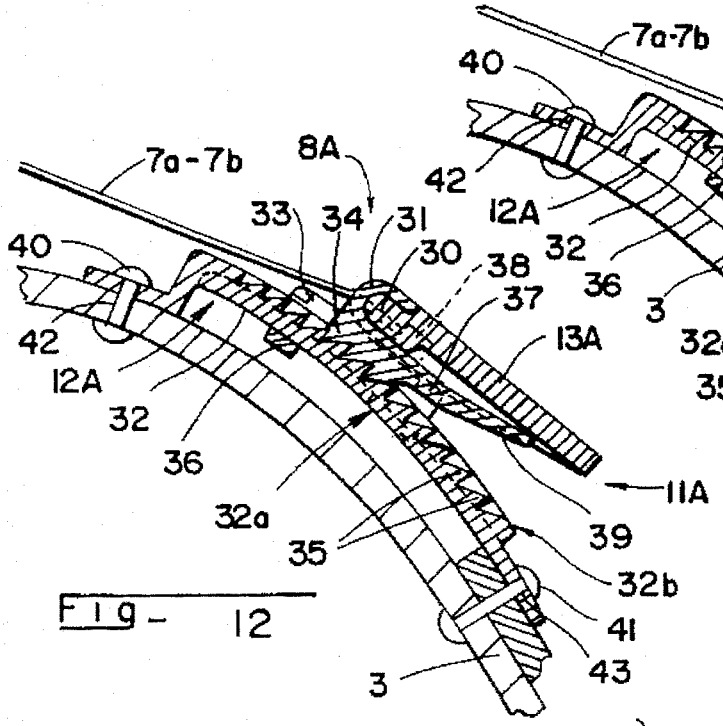
FIGS. 12, 13 and 14 represent a device for latching and adjusting the tightening tension of the closure link of the boot, according to a variation of the embodiment, respectively in the latched, unlatched, disengaged positions.
Figure 13:
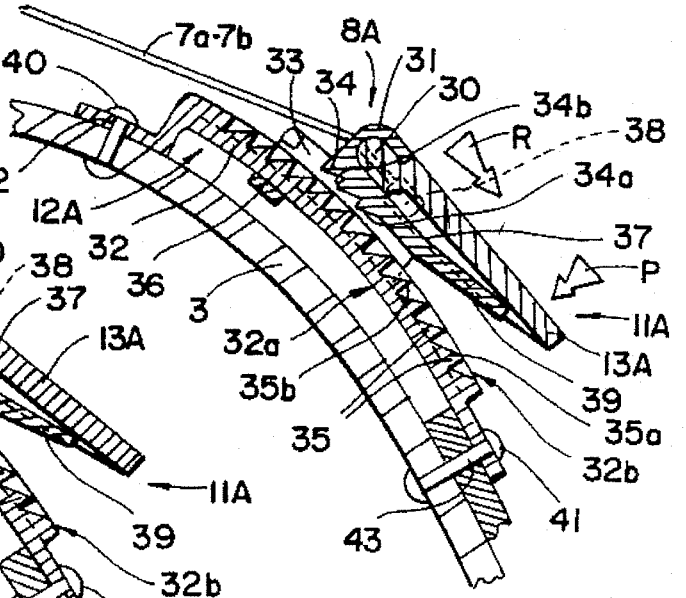
Figure 14:
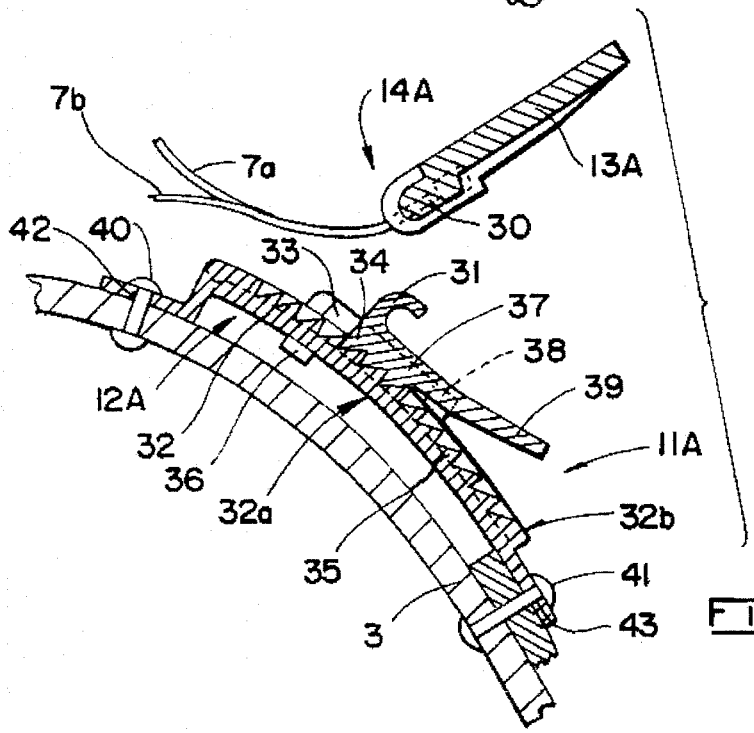

According to an embodiment represented in FIGS. 1–11, more particularly as shown in FIGS. 8 and 9, the removable connection means 14 of tensioning lever 13 are constituted by two bosses 15, 16 (see FIG. 8) provided across from each other within two end arms 17, 18 of the lever 13. These arms 17, 18 are parallel and elastically deformable so as to enable engagement of the bosses 15, 16 in the corresponding guide ramps 19, 20 (see FIG. 11) or receiving depression arranged on two parallel cheeks 21, 22 extending perpendicularly from a base 23 to constitute the fixed gripping portion of upper 3, the base 23 being fixed on the same upper 3.

Further, the free end of tensioning lever 13 is constituted by a hollow body forming a cylindrical bore 24 inside which means for adjusting 11 the tightening tension of link 7 are capable of being housed.

Figure 5:
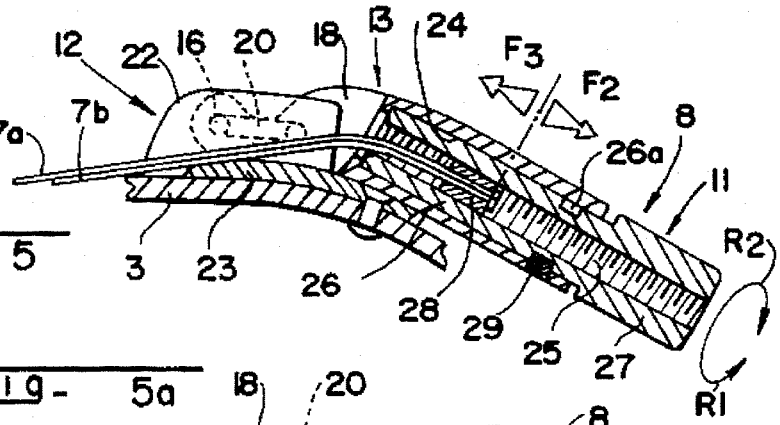
FIGS. 5, 6 and 7 represent, in a longitudinal section, the device as per FIG. 1, respectively latched, unlatched and disengaged.
Figure 5A:
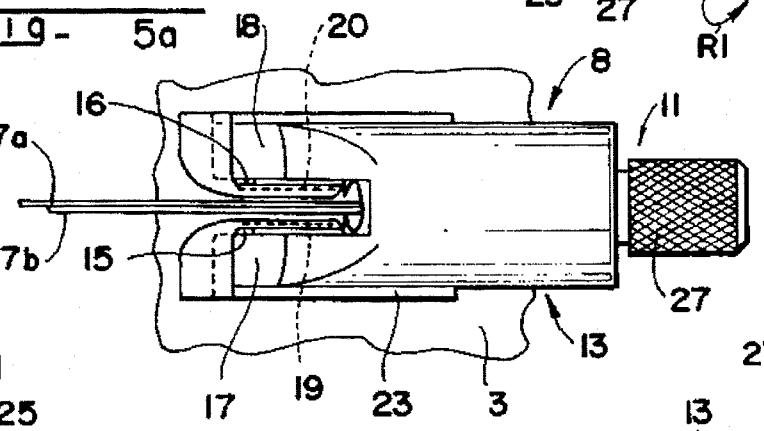
FIG. 5*a* is a top plan view of FIG. 5.

As can be seen more specifically in FIGS. 5–7, the adjustment means 11 are constituted on the one hand by a control member 26 having a substantially cylindrical shape and provided with an internal threading 25, and on the other hand, by a sliding carriage 28 assembled within the control member 26 and in engagement, by an external threading, with the internal threading 25 of such control member.

The control member 26 which has a substantially cylindrical shape, is mounted rotationally inside a cylindrical bore 24 of tensioning lever 13, but is blocked in translation in such lever by a finger 29 projecting radially inside bore 24 and cooperating with an associated peripheral neck 26a of control member 26.

This control member 26 is also provided with an external maneuvering button 27 which projects with respect to tensioning lever 13.

Finally, the ends of slack ends 7*a*, 7*b* that have to be tensioned by means of adjustment means 11 are fixed on the sliding carriage 28.

It is easy to understand that during rotation along direction R1 or R2 of control member 26, a translational displacement of sliding carriage 28 along threading 25 is obtained, because the rotation of such carriage 28 is prevented by the presence of the slack ends 7*a*, 7*b* which enable a fine adjustment of the desired tension to be obtained. It is also easy to envision that the same tension adjustment can be obtained by an inverse assembly of carriage 28 and lever 13, in which the sliding carriage 28 would be blocked rotationally within lever 13 and would be mounted on an internal screw affixed to maneuvering button 27 and blocked in translation in the same lever.

The functioning of the device that has just been described is as follows.

When boot 1 is used for the first time, the user exerts, along direction F, a traction on lever 13 which is held firmly and brought in front of the complementary gripping portion 12 of upper 3 so that bosses 15, 16 snap or click together in ramps 19, 20 (see FIG. 7). This action has the effect of pretensioning link 7 and therefore starting the tightening process.

Once lever 13 is engaged in portion 12, it need only be pivoted in direction F1 (FIG. 6) to obtain its latching (FIG. 5). In this position, it must be noted that bosses 15, 16 are in abutment at the base of guide ramps 19, 20.

At this time, according to the user's requirements, a rotation in direction R1 or R2 of the maneuvering button 27 of the fine adjustment means 11 will bring about a longitudinal displacement along F3 or F2 of sliding carriage 28, to obtain the desired reference tension, according to whether the user wishes to obtain more tightening or less tightening on his foot.

It is easy to understand that such a reference tension is memorized inside the lever whatever its latched or unlatched position and can be reproduced each time the boot is put on, independently of the latching and unlatching operation of lever 13, while enabling an easy removal or putting on of the boot, by a quick release of link 7.

Means for immobilizing button 27 in rotation (not represented in the drawings), can also be provided to eliminate all risks of faulty adjustment.

The embodiment represented in FIGS. 12–15 mainly differs from the previous embodiment in that the removable connection means 14A of tensioning lever 13 are constituted by an anchoring element 30 obtained at one end of the lever 13A, extending in a transverse manner with respect to its longitudinal axis and adapted to cooperate with a hook 31 of a complementary shape, rendered affixed to a fixed portion 12A of upper 3.

According to this embodiment, the adjustment means 11A of the tightening tension of link 7 are constituted by a notched strap 32 constituting the fixed portion 12A of upper 3 and on which is capable of sliding in translation, a carriage 33, bearing the hook 31 for connection with tensioning lever 13A. This hook 31 also comprises notches 34 that are complementary to the notches 35 of strap 32 with which they cooperate as per the position selected, by means of disengageable elastic return means 38.

More specifically, carriage 33 is constituted (see FIGS. 12–13) by a lower smooth portion 36 capable of sliding along a lower smooth surface 32*a*, of strap 32 and an upper portion 37 provided with notches 34 cooperating with an upper face 32*b* provided with notches 35 of strap 32. The upper portion 37 of carriage 33 is connected to its own lower portion 36 via two material bridges 38 constituting a journal with elastic return and enabling the "rotation" of the upper portion 37 for engagement or conversely disengagement of notches 34 with notches 35.

An adjustment operation is thus obtained by disengaging notches 34 from carriage 33, this disengagement being undertaken by activating, in the direction of arrow P a maneuvering lever 39, which extends the upper portion 37 of carriage 33 and is adapted to rock in an angular manner about the two material bridges 38. Then, one need only slide carriage 33 along strap 32 with respect to a fixed support engagement constituted by the lower portion 36 of carriage 33 in contact with the smooth lower surface 32*a* of strap 32. Once the desired adjustment is obtained, lever 39 is released so that due to the elasticity of the material bridges 38, notches 34 return in engagement with notches 35. As is shown especially in FIG. 13, notches 34, 35 have different inclinations on their opposing planes, flanks 34*a*, 35*a* being in a slight slope so as to facilitate sliding of notches 34 of carriage 33 in direction R during tension adjustment, whereas flanks 34*b*, 35*b* on the contrary, are vertical so as to prevent any accidental loosening once the tension adjustment has been undertaken.

Strap 32 is fixed on upper 3 by rivets 40, 41, crossing holes 42, 43. It is assembled so that it is arched in order to retain a sliding space at the lower portion 36 of carriage 33.

Preferably, the lower portion 36 and upper portion 37 of carriage 33 as well as the material bridges 38 connecting them are obtained during the same molding operation of plastic material.

In all cases, link 7 is a non-extensible cable obtained in a material such as polyamide.

Figure 15:
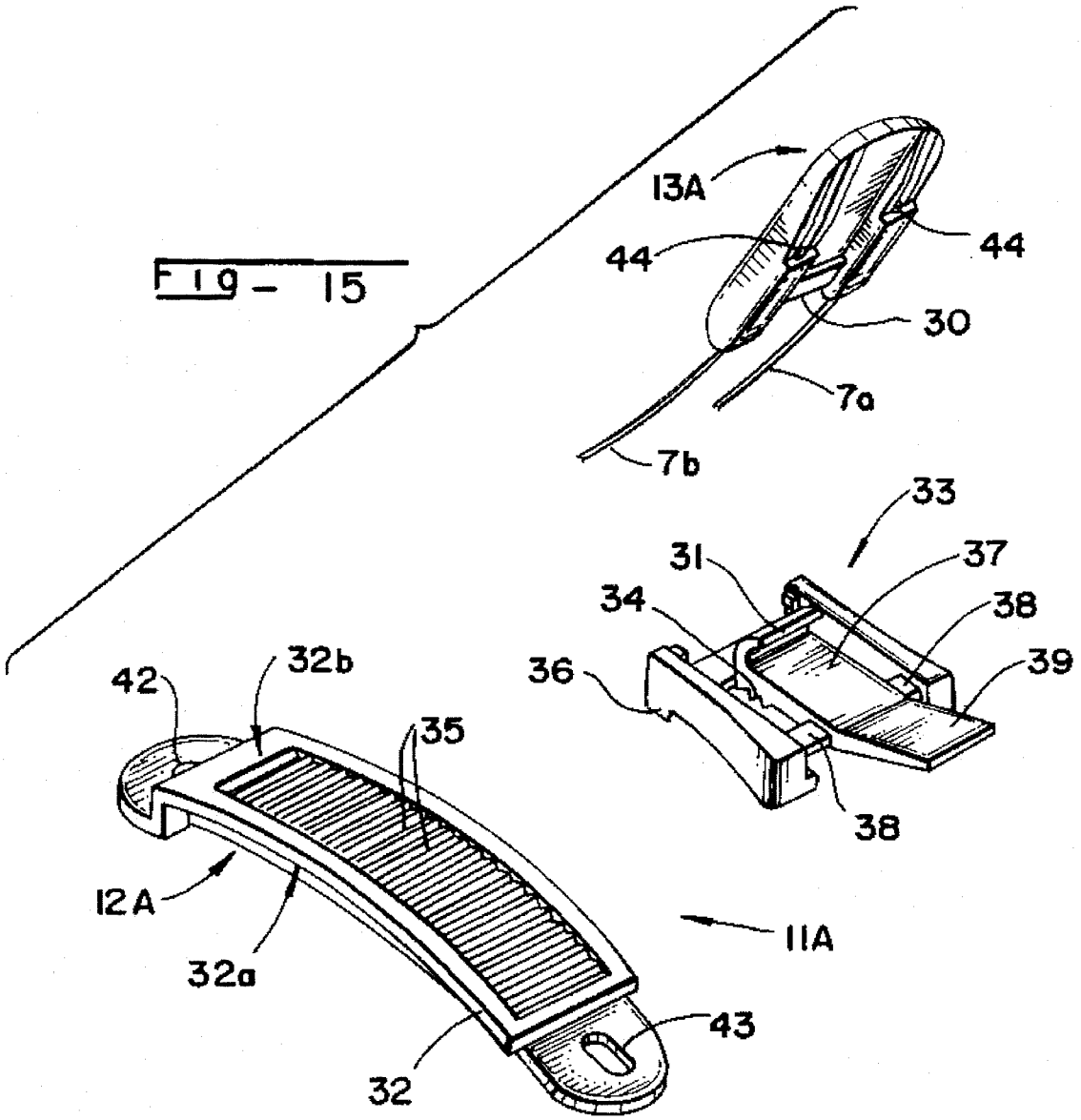
FIG. 15 represents a perspective exploded view of the device as per FIGS. 12–14.

As can be seen in FIG. 15, tensioning lever 13A comprises two openings 44 through which are introduced the free ends of slack ends 7*a*, 7*b* of link 7 to be retained there by any means, for example, by knots.

In the second embodiment which has just been described, the functioning basically differs from the former embodiment in that on the one hand, the latching of tensioning lever 13A is done by means of a hook 31 which is borne by a carriage 33 capable of being rendered slidable, and on the other hand, the fine adjustment of the tightening tension which is obtained precisely by the transverse displacement of the carriage 33 which is notched and which is therefore adapted to cooperate with the notches of the strap constituting a fine adjustment range.

Figure 16:
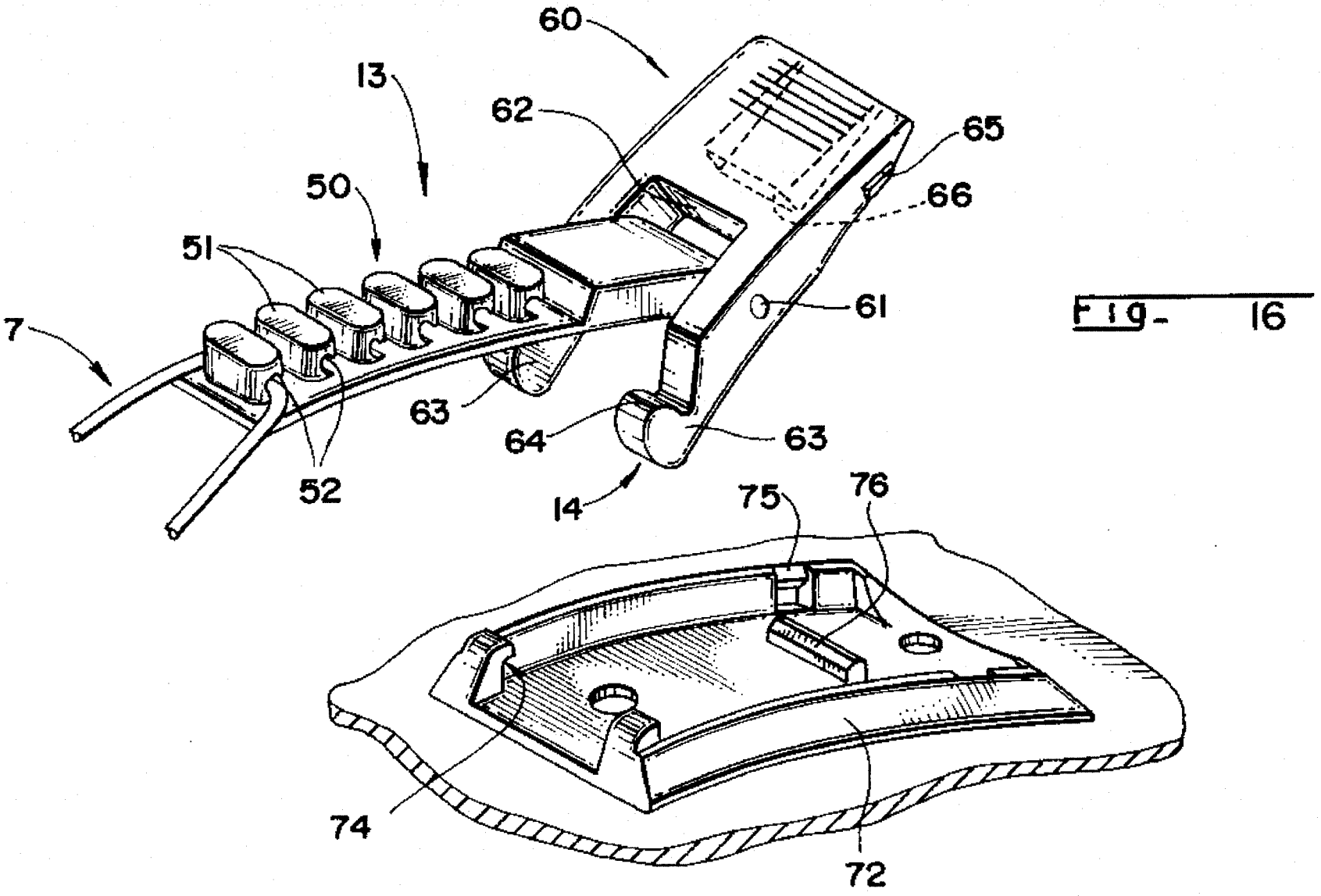
FIGS. 16 and 17 are perspective exploded views of a device for latching and adjusting the tightening tension as per two other embodiments.

In the embodiment of FIG. 16, the tensioning lever 13 is formed of two portions 50, 60 journalled to one another, one of such portions 60 constituting the actual tensioning lever, whereas the other portion 50, has the shape of a flat strap bearing the adjustment means.

In this case, the adjustment means are constituted by simple notches or hooks 51 located on the strap according to a predetermined step and comprise, on the side of their opening, a projection 52 adapted to retain flexible link 7 in the neck thus defined between the hook and strap 50.

For adjustment, in a progressive though discontinuous manner, of the tension adjustment, one need only position the flexible link in the appropriate hook 51.

The tensioning lever 60 has, at its end that is located at the side of strap 50, a recess 62 adapted to receive an end portion of the strap 50 and comprises journal 61 between strap 50 and lever 60.

This recess 62 is demarcated by two arms 63, each of these arms being provided at its end with a hump 64 adapted to cooperate with an associated housing 74 of a base 70 fixed on the upper for the removable connection 14 of the lever to the upper.

Lever 60 comprises, besides, on each side, a projection 65 adapted to click together in an associated recess 75 arranged on each side of base 70 for latching in the vertical direction of the lever with respect to the base.

Finally, a retention in a horizontal plane of lever 50 in base 70 is constituted by the cooperation of a recess 66 of such lever with a transverse abutment 76 arranged at the bottom of the base, the clicking of these two elements constituting an anti-return in the horizontal plane.

Finally, it must be noted, that the raised edges 72 of the base constitutes a stream-lined protection of lever 60 and stops an accidental unlatching thereof.

The embodiment of the assembled tensioned lever in FIG. 16 enables, as also in the case of the lever of FIGS. 5–7, a closing and latching of the lever by a knuckle joint effect, the journal of the lever on the base enabling the shifting of the opening/closing forces.

Further, obtaining the adjustment means in the shape of a notched strap 50 having an extremely flat shape and mounted in a journalled manner on the lever enables one to have a latching and tension adjustment system which is particularly "flat", i.e., with minimum volume and weight. This volume can be reduced even further by pushing back journal 61 of strap 50 towards the opposite end of the lever so that recess 62 of the lever can completely house such strap 50.

Figure 17:
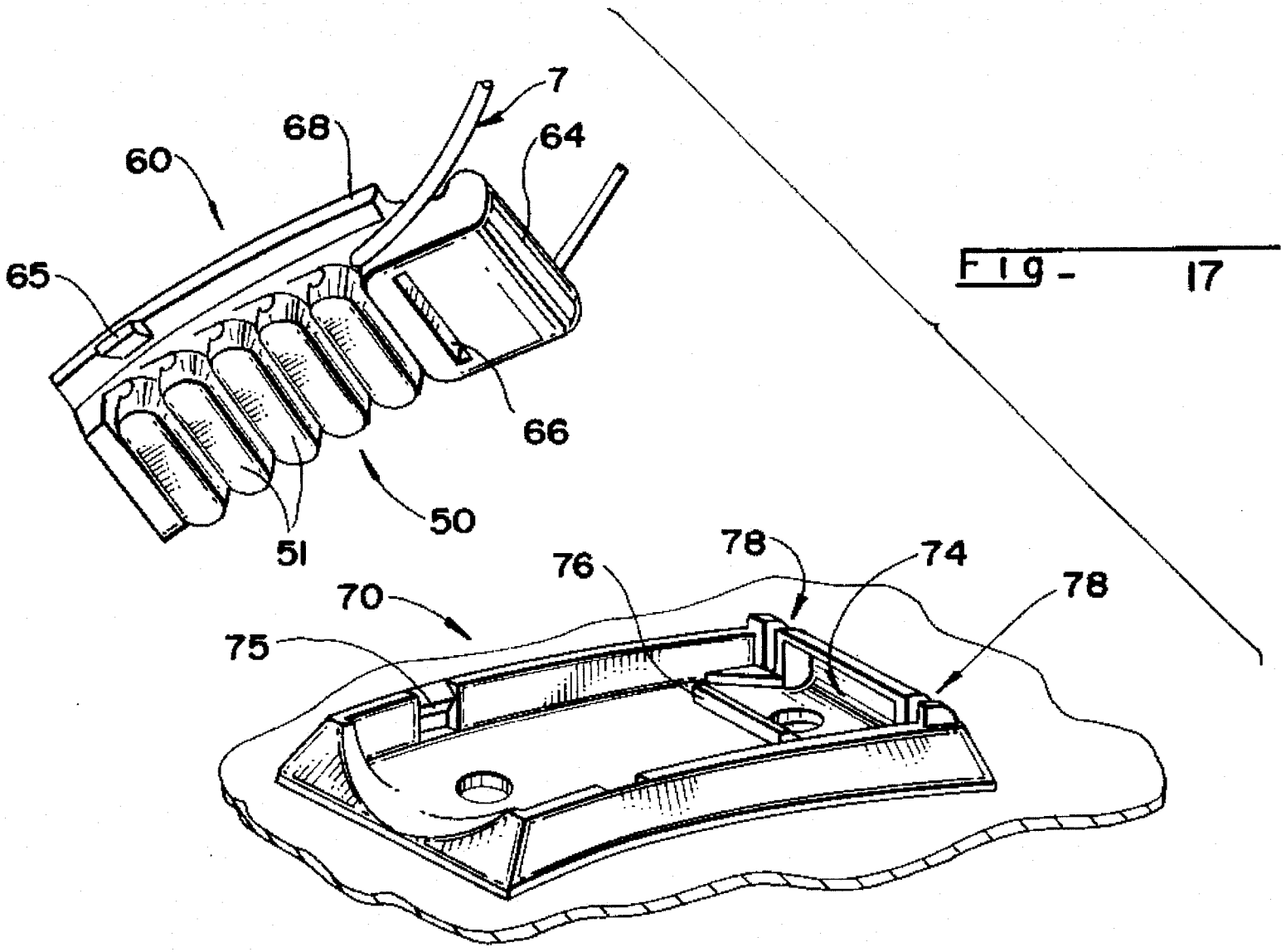

FIG. 17 shows an embodiment of the tensioning lever based on the same concept as the tensioning lever of FIG. 16 but integrating the notched strap in the lever.

In the case of FIG. 17, in which the same elements will be designated by the same references as in FIG. 16, lever 60 is therefore provided at one end with a boss 64 adapted to cooperate with an associated housing 74 of a base 70 and is provided with clicking means 65, 66 cooperating with the associated clicking means 75, 76 of base 70 for retention respectively in the vertical and horizontal directions of lever 60 in base 70.

Further, lever 60 comprises on its lower surface, a portion provided with notches 51, constituting the notched strap 50, and adapted to receive the flexible link 7.

Finally, a shoulder 68 is provided on each side of strap 50 and two openings 78 are arranged in housing 74 of base 70 for passage of the flexible link 7 once lever 60 is closed.

The embodiment of FIG. 17 enables a latching and adjustment system to be obtained which is even more compact than the embodiment of FIG. 16.

The instant application is based upon French patent application 92.13567 of Nov. 6, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A boot comprising:

an external sole;

an upper extending upwardly from said sole, said upper comprising a supple material, said upper having a forwardly facing opening to enable insertion and removal of a wearer's foot within the boot, said upper further comprising two quarters, said two quarters forming said opening;

an opening and closing system for connecting said two quarters of said upper, said opening and closing system comprising:

a series of return elements fixed on each of said quarters;

a link being laced around and connecting a plurality of said return elements;

a tightening and latching device connected to said link; and a fixed complementary gripping device, fixed to the boot, said tightening and latching device being engagable with said fixed complementary gripping device;

said tightening and latching device comprising a means for tightening and latching said link and for moving said quarters in a direction toward each other for ensuring retention of the foot within the boot, said tightening and latching device comprising means for latching said link in position under the effect of a predeterminate tensioning force;

said opening and closing system further comprising a progressive adjustment mechanism independent of said tightening and latching device for memorizing said predeterminate tensioning force of said tightening and latching device;

said tightening and latching device comprising means for detachment from said fixed complementary gripping device without affecting said memorizing of said predeterminate tensioning force of said progressive adjustment mechanism;

said tightening and latching device comprising a tensioning lever, said progressive adjustment mechanism being carried by said tensioning lever; and said link having two ends, said two ends being connected to said progressive adjustment mechanism.

2. A boot according to claim 1, wherein:

said link consists of a single link forming a closed circuit, said link having ends consisting only of said two ends connected to said progressive adjustment mechanism.

3. A boot according to claim 1, wherein:

said tensioning lever having a removable connectable end;

said fixed complementary gripping device having a portion complementary to said removable connectable end of said tensioning lever; and said removable connectable end being removably attachable to said complementary portion of said complementary gripping device for enabling said tensioning lever to be attached to said fixed complementary gripping device.

4. A boot according to claim 3, wherein:

said removable connectable end of said tensioning lever comprises at least one boss provided on an end of said tensioning lever;

said portion of said fixed complementary gripping device comprising at least one respective receiving depression for said at least one boss, wherein said tensioning lever is removably attachable to said complementary gripping device by means of said at least one boss being received within said at least one receiving depression.

5. A boot according to claim 3, wherein:

said removable connectable end of said tensioning lever comprises an anchoring element extending transversely to a longitudinal axis of said tensioning lever;

said anchoring element being removably attachable to said complementary portion of said complementary gripping device for enabling said tensioning lever to be attached to said fixed complementary gripping device.

6. A boot according to claim 5, wherein:

said fixed complementary gripping device comprises a notched strap;

said progressive adjustment mechanism comprises a carriage, said carriage comprising means for translational sliding on and engagement with said notched strap, said carriage comprising notches for engagement with said notched strap at a selective position by means of a disengagable elastic return means.

7. A boot according to claim 6, wherein:

said carriage comprises a smooth lower portion for sliding upon a smooth lower surface of said notched strap and an upper mobile portion having notches cooperating with an upper notched surface of said notched strap, said upper portion of said carriage being connected to said lower portion of said carriage with a limited possibility of rotation, said carriage having a maneuvering lever, whereby an elastic return of said carriage immediately after an adjustment operation being obtained by disengagement from said notches of said carriage by means of said maneuvering lever.

8. A boot according to claim 7, wherein:

said carriage further comprises elastically deformable elements for enabling said limited possibility of rotation.

9. A boot according to claim 1, wherein:

said link is a non-extensible flexible cable.

10. A boot according to claim 1, wherein:

said tightening and latching device comprises a single tensioning lever.

11. A boot according to claim 1, wherein:

said tightening and latching device comprises a single tensioning lever;

said link comprises a single cable having each opposite end thereof connected to said single tensioning lever.

12. A boot according to claim 1, wherein:

said tensioning lever comprises a hollow body forming a cylindrical bore within which said progressive adjustment mechanism of said opening and closing system is housed.

13. A boot according to claim 12, wherein:

said progressive adjustment mechanism of said opening and closing system comprises a control member threaded internally and a sliding carriage mounted within said control member for translation within said control member but against rotation within said control member, said end of said closed circuit being connected to said sliding carriage.

14. A boot according to claim 13, wherein:

said control member comprises a sleeve, said tensioning lever comprises a cylindrical bore, said sleeve being located within said cylindrical bore of said tensioning lever, said progressive adjustment mechanism further comprising a radial finger in engagement with both said sleeve and a wall of said cylindrical bore for mounting said sliding carriage for translation but against rotation within said control member.

15. A boot according to claim 1, wherein:

said link is non-extensible cable.

16. A boot comprising:

an external sole;

an upper extending upwardly from said sole, said upper comprising a supple material, said upper having a forwardly facing opening to enable insertion and removal of a wearer's foot within the boot, said upper further comprising two quarters, said two quarters forming said opening;

an opening and closing system for connecting said two quarters of said upper, said opening and closing system comprising:

a series of return elements fixed on each of said quarters;

a link forming a closed circuit and being laced around and connecting a plurality of said return elements;

a tightening and latching device connected to said link; and a fixed complementary gripping device, fixed to the boot, said tightening and latching device being engagable with said fixed complementary gripping device;

said tightening and latching device comprising a means for tightening and latching said link and for moving said quarters in a direction toward each other for ensuring retention of the foot within the boot, said tightening and latching device comprising means for latching said link in position under the effect of a predeterminate tensioning force;

said opening and closing system further comprising a progressive adjustment mechanism independent of said tightening and latching device for memorizing said predeterminate tensioning force of said tightening and latching device;

said tightening and latching device and said fixed complementary gripping device comprising means for facilitating detachment of said tightening and latching device from said fixed complementary gripping device without affecting said memorizing of said predeterminate tensioning force of said progressive adjustment mechanism;

said tightening and latching device comprising a tensioning lever connecting an end of said closed circuit formed by said link, said tensioning lever having a removable connectable end, said removable connectable end comprising a part of said means for detaching;

said fixed complementary gripping device having a portion complementary to said removable connectable end of said tensioning lever, said complementary portion comprising another part of said means for detaching; and said removable connectable end being removably attachable to said complementary portion of said complementary gripping device for enabling said tensioning lever to be attached to said fixed complementary gripping device.

17. A boot according to claim 16, wherein:

said fixed complementary gripping device comprising an end having a transversely extending housing;

said removable connectable end of said tensioning lever comprises a transversely extending bump for being frictionally received within said housing of said complementary gripping device.

18. A boot according to claim 17, wherein:

said tensioning lever comprises a strap having a series of notches for receiving and retaining said link at different positions along a length of said lever for said memorizing said predeterminate tensioning force of said tightening and latching device.

19. A boot according to claim 16, wherein:

said progressive adjustment mechanism comprises a notched strap for receiving said link, said strap being attached to said tensioning lever.

20. A boot according to claim 19, wherein:

said notched strap is journalled on said tensioning lever.

21. A boot according to claim 19, wherein:

said notched strap is integrated into said tensioning lever.

* * * * *